US005765633A

United States Patent [19]

Hu

[11] Patent Number: 5,765,633

[45] Date of Patent: Jun. 16, 1998

[54] CONDENSER FOR A REFRIGERATING CIRCUIT

[75] Inventor: Zaiqian Hu, Guyancourt, France

[73] Assignee: Valeo Thermique Moteur, Le Mesnil-Saint-Denis, France

[21] Appl. No.: 822,724

[22] Filed: Mar. 24, 1997

[30] Foreign Application Priority Data

Mar. 25, 1996 [FR] France ..... 96 03695

[51] Int. Cl.[6] ..... F28F 9/02

[52] U.S. Cl. ..... 165/174; 165/175; 165/173; 165/176; 29/890.052

[58] Field of Search ..... 165/173, 174, 165/175, 176, 110; 29/890.052

[56] References Cited

U.S. PATENT DOCUMENTS

| | | | |
|---|---|---|---|
| 5,082,051 | 1/1992 | Ando | 165/173 X |
| 5,168,925 | 12/1992 | Suzumura et al. | 165/176 |
| 5,203,407 | 4/1993 | Nagasaka | 165/176 X |
| 5,265,673 | 11/1993 | Hucsko | 165/176 |
| 5,546,761 | 8/1996 | Matsuo et al. | 165/173 X |
| 5,596,877 | 1/1997 | Morrison | 165/176 X |
| 5,605,191 | 2/1997 | Eto et al. | 165/176 |

*Primary Examiner*—Denise L. Ferensic
*Assistant Examiner*—Christopher Atkinson
*Attorney, Agent, or Firm*—Morgan & Finnegan L.L.P.

[57] ABSTRACT

A condenser for a refrigerating circuit, in particular an air conditioning installation for a motor vehicle, comprises two headers at respective ends of a bundle of tubes, together with a reservoir communicating with one of the headers. The reservoir and this header are integrated within a common casing having a tubular wall which is divided, by a longitudinal separating baffle, into a collecting chamber, constituting the header into which the tubes of the condenser are open, and a reservoir chamber which communicates with the collecting chamber through apertures formed in the longitudinal baffle. This baffle has a longitudinal edge engaged in a longitudinal slot in the casing wall, and another longitudinal edge which bears against the tubular wall, so that the various components can be secured together by brazing.

10 Claims, 2 Drawing Sheets

CONDENSER FOR A REFRIGERATING CIRCUIT

FIELD OF THE INVENTION

This invention relates to condensers for refrigerating circuits, for example the circuit of a motor vehicle air conditioning installation. More particularly, it relates to condensers for refrigerating circuits through which a refrigerant fluid flows, the condenser comprising a bundle of finned tubes mounted between two headers, together with a reservoir with which one of the two headers is in communication.

BACKGROUND OF THE INVENTION

In such a refrigerating circuit, the refrigerant fluid is delivered, in a superheated vapour phase, by a compressor to the condenser, in which it is successively cooled or "de-superheated", condensed to a hot liquid phase, and then "supercooled" into a cold liquid phase. The refrigerant fluid, thus condensed and cooled, is then taken, via an expansion device or depressuriser, to an evaporator in which it exchanges heat with an air stream which is to be passed into the cabin of a vehicle. The fluid is converted into the vapour phase in the evaporator, while the air stream is cooled so as to constitute the conditioned air. The refrigerant fluid in its vapour phase leaves the evaporator so as to pass to the compressor, and so on.

In known condensers of the above type, the reservoir, which is normally connected to the outlet of the condenser, is made in the form of a separate unit.

It is known, from French patent application No. 93 10325 of the present Applicants, to provide a condenser of this type in which the reservoir has a tubular configuration and is attached to one of the headers, which is also of tubular configuration, by means of snap-fitting lugs. It is also known to make a tubular reservoir by extrusion, and to seam the extruded reservoir externally on a tubular header. However, these known arrangements tend to increase the overall size of the condenser, and in addition they make it necessary to perform complex operations in order to achieve sealed mechanical assembly between the reservoir and the header with which it is in communication.

In addition, these known arrangements do not lead to any simplification in the fitting of transverse baffles (dividing walls) within the header.

DISCUSSION OF THE INVENTION

A main object of the present invention is to overcome the above mentioned drawbacks.

According to the invention, a condenser for a refrigerant fluid in a refrigerating circuit, the condenser comprising a bundle of finned tubes mounted between two headers, with one of the said headers communicating with a reservoir, is characterised in that the said header and the reservoir are bounded by a common casing having a tubular wall, which is divided by a longitudinal separating baffle into a collecting chamber, into which the tubes of the tube bundle are open, and a reservoir chamber which communicates with the collecting chamber through apertures formed in the longitudinal separating baffle, and in that the longitudinal separating baffle has a first longitudinal edge engaged in a longitudinal slot formed in the tubular wall of the said casing, together with a second longitudinal edge which bears against the tubular wall of the casing, so as to enable the casing and the longitudinal separating baffle to be secured together by brazing.

The collecting chamber constitutes the header that communicates with the reservoir, and it is the reservoir chamber that constitutes this reservoir. Thus, the header and reservoir together constitute two adjacent chambers formed within a common tubular casing, which, in particular, enables the overall size of the assembly consisting of the header and the reservoir to be reduced, while also simplifying the assembly operations.

The division of the tubular casing into the two chambers is achieved very simply by means of a longitudinal separating bulkhead or separator, which is brazed to the tubular wall of the common casing.

According to a preferred feature of the invention, the tubular wall of the casing is of generally cylindrical form. This configuration optimises the reduction of the size of the casing, while maximising the mechanical strength of the latter against the pressure of the refrigerant fluid. However, the cross section of the casing may be cylindrical, with a cross section which is either circular or non-circular, such as oval.

Preferably, the tubes of the tube bundle extend in a non-radial direction with respect to the centre of the cylindrical cross section of the tubular wall of the casing. The term "centre", as used herein, means the geometrical or mathematical centre in the sense of the width of the cross section of the casing, whether the latter be circular or non-circular. The above preferred feature enables easier communication to be obtained between the tubes of the tube bundle and the header constituted by the collecting chamber, which preferably has a smaller volume than the volume of the reservoir chamber.

According to another preferred feature of the invention, the longitudinal separating baffle comprises two flat wall portions defining an angle between them and including the first longitudinal edge and the second longitudinal edge respectively. The longitudinal baffle is thus able to be made easily by bending a metallic strip longitudinally into an angle-iron configuration.

Preferably, the angle defined between the two flat wall portions of the longitudinal separating baffle is approximately equal to 90 degrees. This preferred form of the longitudinal baffle is most particularly suitable to the case where the tubular wall of the casing has a circular cylindrical form. Where it is of this form, then, according to a further preferred feature of the invention the apex of the angle defined between the two flat wall portions of the longitudinal separating baffle lies substantially at the centre of the circular cross section of the tubular wall, so that the transverse cross sections of the collecting chamber and the reservoir chamber correspond respectively to substantially one-quarter and substantially three-quarters of the total transverse cross section of the tubular wall.

According to yet another preferred feature of the invention, the condenser further includes transverse baffles which are located in the collecting chamber.

In preferred embodiments of the invention, each transverse baffle comprises a first portion which constitutes the baffle proper, and which corresponds to the transverse cross section of the collecting chamber, together with a second portion which corresponds to part of the transverse cross section of the reservoir chamber, the two said portions defining between them a slot which is adapted to engage in a corresponding slot formed in the second longitudinal edge of the longitudinal separating baffle.

It is thus only the said first portion of each transverse baffle that constitutes the baffle proper, that is to say the working part of the baffle. The second portion has two functions, one of which is to define the above mentioned slot, its other function being to retain the longitudinal baffle within the common casing. In this connection, the transverse baffles are first fitted on to the longitudinal baffle by cooperation of the slots in the latter with those in the transverse baffles, and the assembly thus formed is then inserted axially into the casing. This introduction of the baffle assembly is performed in such a way that the first longitudinal edge of the longitudinal baffle engages in the longitudinal slot in the tubular wall of the casing.

Once the baffles have been inserted into the casing in this way, correct positioning of the longitudinal baffle is ensured, while the engagement of the transverse baffles against the tubular wall of the casing, so as to define a plurality of sub-chambers within the collecting chamber, and to subsequently enable the refrigerant fluid to flow in a plurality of passes, is also ensured.

According to a still further preferred feature of the invention, the tubular wall of the casing is formed by rolling a metallic strip so as to define two parallel longitudinal edges which define between them the said longitudinal slot of the said casing.

In another preferred feature, the invention provides the longitudinal baffle and the transverse baffles in the form of metallic elements which are coated with a layer of braze metal.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
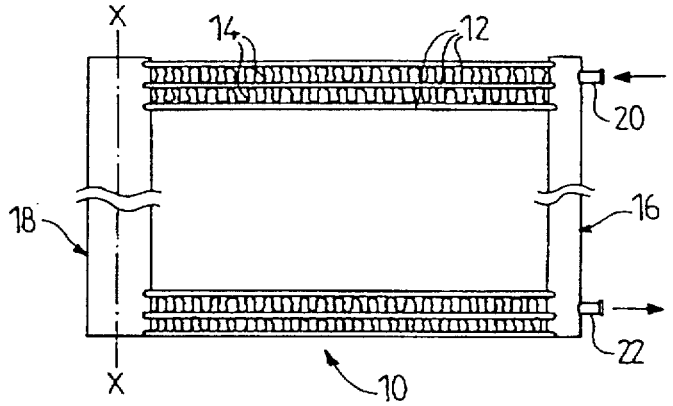
FIG. 1 is a view in elevation of a condenser in a preferred embodiment of the invention.

The condenser shown in FIG. 1 comprises a tube bundle 10 which consists of a multiplicity of flat tubes 12, between which there are fitted generally corrugated inserts 14 which define fins acting as heat transfer surfaces. The tube bundle 10 is mounted between a tubular header 16 and a tubular casing 18. The header 16 and the tubular casing 18 have a circular cross section, defining axes which are parallel to each other. The header 16 has an inlet pipe connection 20 and an outlet pipe connection 22, for a refrigerant fluid. This refrigerant fluid, in the form of a superheated vapour phase, is delivered through a compressor (not shown) to the inlet pipe connection 20. The fluid is then successively cooled, or de-superheated, condensed to a hot liquid phase, and is then "supercooled" to a cold liquid phase before leaving the condenser via the outlet pipe connection 22.

Figure 2:
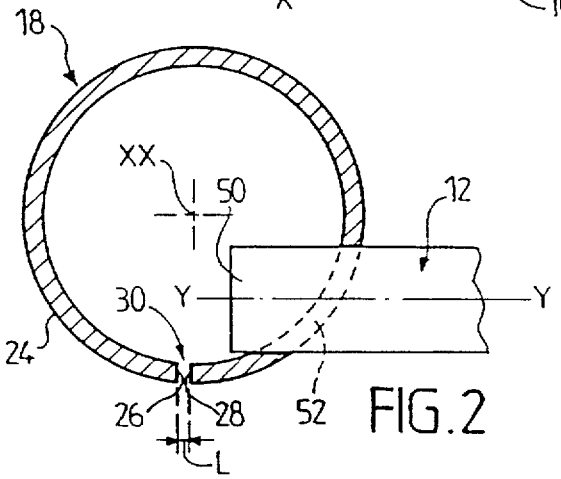
FIG. 2 is a view in partial cross section, on a larger scale, of the condenser shown in FIG. 1, and shows the structure of the casing.
Figure 3:
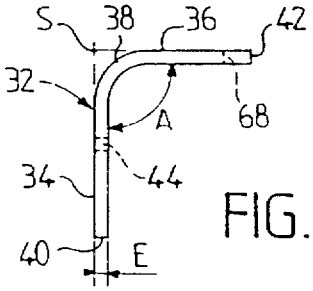
FIG. 3 is an end view of the longitudinal baffle with which the casing seen in FIG. 2 is equipped.
Figure 4:
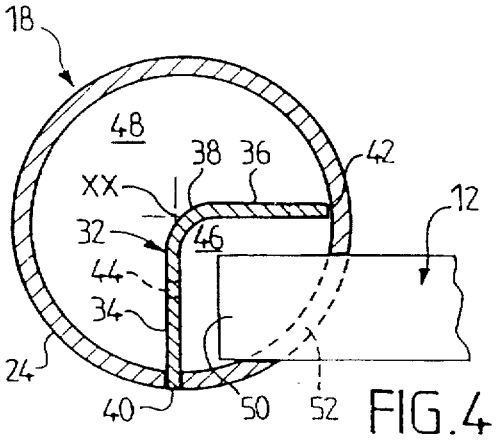
FIG. 4 is a view similar to that of FIG. 2, after the longitudinal baffle of FIG. 3 has been fitted in position.

Reference is now made more particularly to FIGS. 2 to 4, in order to describe the structure of the tubular casing 18.

The casing 18 has a tubular wall 24 which defines a cylinder of revolution about an axis X—X, so that its transverse cross section is circular, with a centre intersected by the axis X—X. The wall 24 is made by a rolling operation on a metallic strip, which is for example of aluminum or aluminum alloy, so as to form two longitudinal edges 26 and 28 which together define between them a longitudinal slot 30 extending parallel to the generatrices of the wall 24. The slot 30 has a width L (see FIG. 2).

The casing 18 is adapted to receive within it a longitudinal separating baffle 32 which is shown by itself in FIG. 3. This longitudinal baffle is made by a bending operation on a metallic strip so as to form two flat wall portions 34 and 36 defining an angle A between them. In this example the angle A is substantially equal to 90 degrees. The wall portions 34 and 36 are joined together by a rounded portion 38, so that the angle A is defined at a virtual apex point S. In addition, the wall portions 34 and 36 have a first longitudinal edge 40 and a second longitudinal edge 42, respectively. The wall portion 34 is formed with at least two communication holes 44, only one of which can be seen in FIG. 3. The baffle 32 has a thickness E which is slightly smaller than the width L of the slot 30.

The baffle 32 is arranged to be inserted into the interior of the tubular wall 24 of the casing, so that the longitudinal edge 40 comes into engagement in the slot 30, with the other longitudinal edge 42 coming into abutment against the internal surface of the tubular wall 24, as can be seen in FIG. 4. The separating baffle 32 therefore defines within the casing 18 a collecting chamber 46 and a reservoir chamber 48. In the particular configuration shown in the drawings, the virtual apex point S (FIG. 3) of the longitudinal baffle 32 lies close to, or coincides with, the axis X—X. As a result, the transverse cross section of the collecting chamber 46, and that of the reservoir chamber 48, correspond substantially to one quarter and three quarters, respectively, of the total transverse cross section of the tubular wall 24. In this connection, it is preferable that the reservoir chamber occupies more than one half of the total volume of the casing 18.

As is shown in FIGS. 2 and 4, the tubes 12 have end portions 50 which are introduced into elongate holes 52 formed through the thickness of the tubular wall 24 of the casing 18, so that the end portions 50 are thereby introduced into the region of the latter that corresponds to the collecting chamber 46. The tubes 12 have respective axes Y—Y which extend in a non-radial direction with respect to the centre of the circular cross section of the casing wall 24, the purpose of this being to facilitate better location of the tubes 12 having regard to the configuration of the collecting chamber 46. The two chambers 46 and 48 do of course communicate with each other through the above mentioned communication holes 44.

Figure 5:
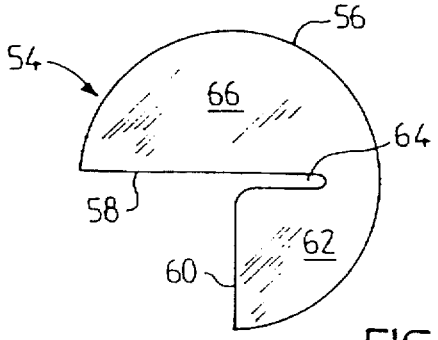
FIG. 5 is a view in elevation of a transverse baffle which is adapted to be fitted laterally inside the longitudinal baffle seen in FIG. 3, and to be placed in the casing of FIGS. 2 and 4.

The casing 18 further includes several transverse baffles 54, one of which is shown by itself in FIG. 5. In this example, each of these transverse baffles 54 has the approximate form of a circular sector bounded by a circular perimeter edge 56, the radius of which is matched to the internal radius of the tubular casing wall 24, with the perimeter edge 56 extending over three-quarters of the circumference. The ends of the perimeter edge 56 are joined to two radial edges 58 and 60 which extend at right angles to each other. The transverse baffle 54 consists of a first portion 62 which extends over one quarter of the circumference, extending from the radial edge 60 to a generally radial slot 64 aligned with the radial edge 58; together with a second portion 66 which extends over one half of the circumference between the slot 64 and the free edge 58.

The first portion 62 of the baffle 54 has a shape which is matched to that of the transverse cross section of the collecting chamber 46, and therefore constitutes the baffle proper, or working portion of the transverse baffle 54. By contrast, the second portion 66 of the latter is arranged to bear against the tubular wall 24 without itself actually serving as a baffle element.

Figure 6:
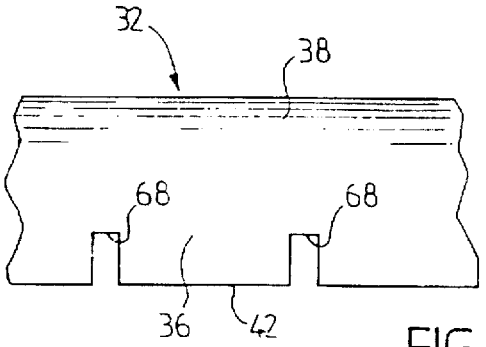
FIG. 6 again shows the baffle of FIG. 3, being a side view showing part of the baffle as seen from the left hand side of FIG. 3.
Figure 7:
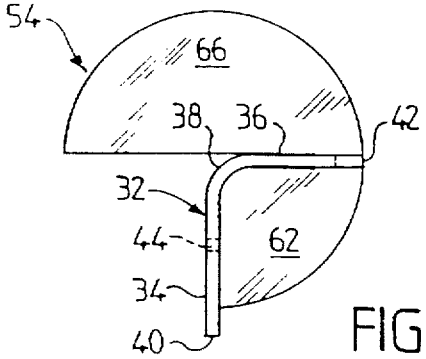
FIG. 7 is an end view of the longitudinal baffle, with a transverse baffle pre-fitted on it.

As can be seen best in FIG. 6, the longitudinal baffle 38 is formed with a number of slots 68, each of which is arranged to cooperate with the slots 64 of a respective transverse baffle 54. The transverse baffles 54 can thus be fitted laterally on to the longitudinal baffle 32, so that the slots 64 correspond with the respective slots 68. The resulting assembly of baffles is shown in FIG. 7. This assembly can then be inserted into the tubular wall 24, so that the longitudinal edge 40 of the longitudinal baffle 32 slides within the slot 30 of the casing 18 itself, with the longitudinal edge 42 of the longitudinal baffle 32 automatically engaging against the interior of the tubular wall 24. Precise positioning of the longitudinal baffle 32 and the transverse baffles 54 is thus ensured. Once this operation has been carried out, it is then only necessary to introduce the respective end portions 50 of the tubes 12 into the holes 52 in the wall 24.

The opposite ends of the tubes 1 2 can be introduced in their turn into appropriate holes formed in the wall of the header 16.

Figure 8:
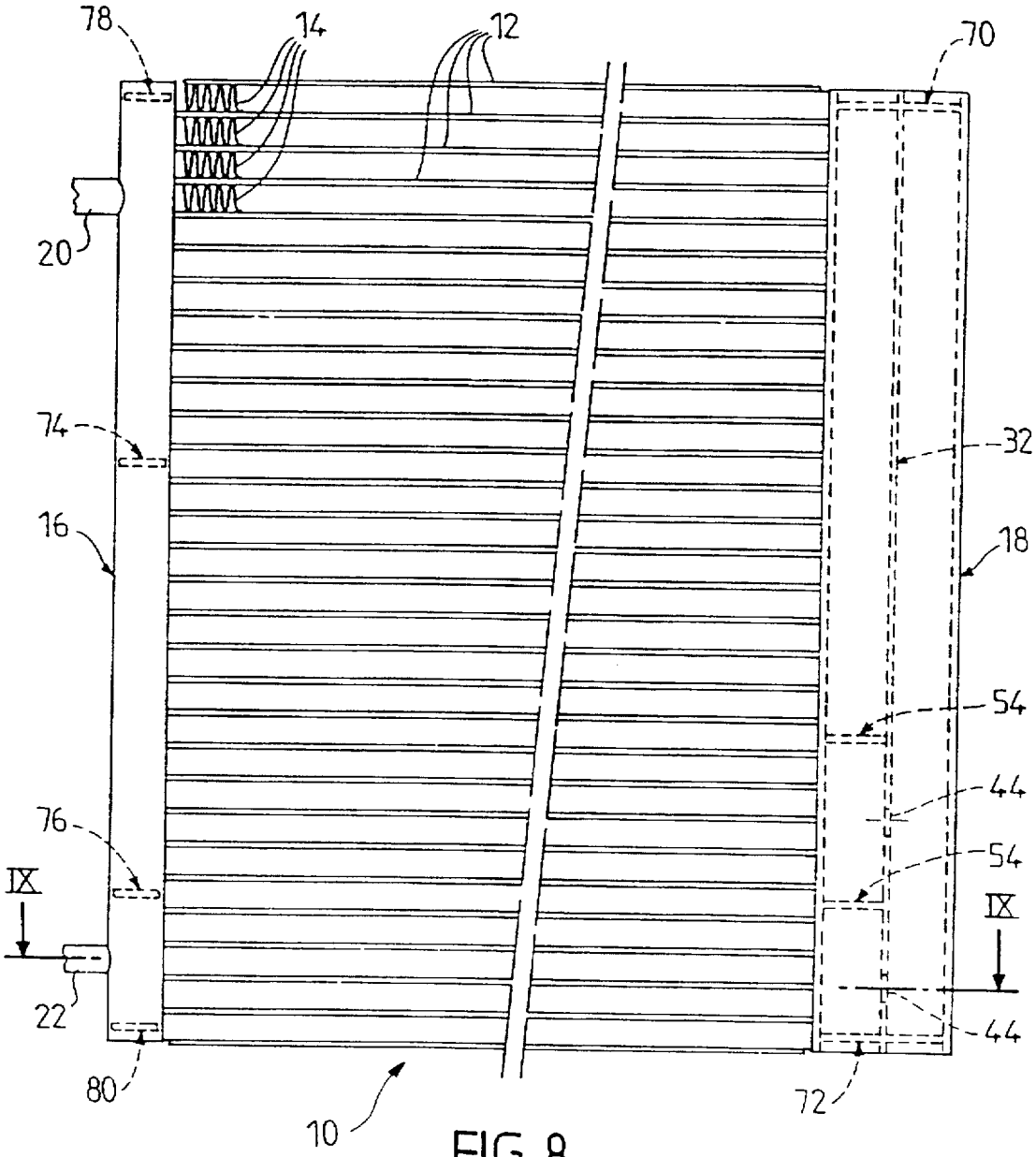
FIG. 8 is a view in elevation of a condenser similar to that in FIG. 1.
Figure 9:
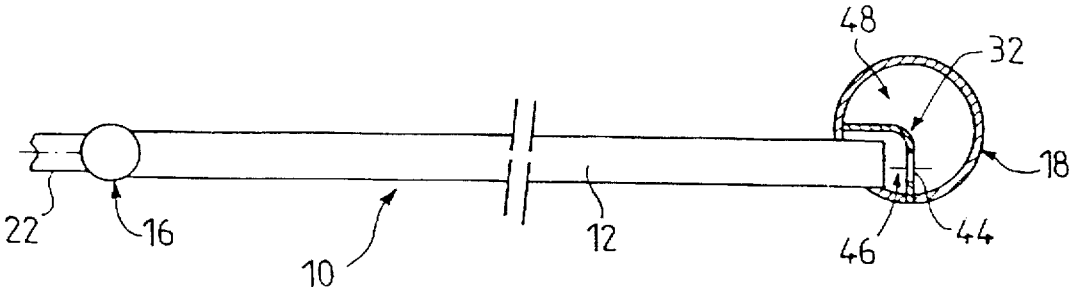
FIG. 9 is a view in cross section taken on the line IX—IX in FIG. 8.

With reference to FIGS. 8 and 9, the condenser shown in these Figures is similar to that in FIG. 1. The casing 18 contains a longitudinal baffle 32 having two communicating holes 44 and carrying two transverse baffles 54. The casing 18 is closed by two end plates 70 and 72. As a result, the refrigerant fluid is able to flow within the condenser in two successive passes.

The various components of the condenser, and in particular the casing 18, the longitudinal baffle 32 and the transverse baffles 54, are coated with a layer of braze metal. As a result, after the various components of the condenser have been assembled together, the condenser can be put into an appropriate oven so that the brazing operation, securing all the components together, can be carried out.

In this way, the invention enables a condenser to be obtained in which the reservoir, and one of the headers, are defined by a common casing, having a compact structure which can easily be consolidated into a monobloc unit by brazing. In this connction, it will be understood that the collecting chamber 46 in the casing 18 constitutes a second header.

It should be noted that the invention also enables the problem of fitting the transverse baffles to be resolved, this operation having normally hitherto called for delicate seaming operations.

The condenser provided by the invention enables various flow patterns of the refrigerant fluid to be obtained. In particular, it enables this fluid to enter and leave the reservoir before being "supercooled" in the condenser, or again, to leave the condenser before entering and leaving the reservoir.

The invention is suitable most particularly (though without limitation) for condensers in air conditioning installations for motor vehicles.

What is claimed is:

1. A condenser for a refrigerant fluid in a refrigerating circuit, the condenser having a plurality of components comprising a first header, a second header, a reservoir, and a tube bundle, the tube bundle comprising a plurality of tubes and cooling means between said tubes, the tube bundle being mounted between said first and second headers, wherein the condenser includes a casing having a tubular wall, and a longitudinal separating baffle within said casing, said longitudinal baffle dividing the interior of said casing into a reservoir chamber, constituting said reservoir, and a collecting chamber constituting said second header, whereby said reservoir and said second header are defined by a common casing, said tubes being open into the collecting chamber and said longitudinal baffle having apertures putting said reservoir chamber and collecting chamber into communication with each other, the longitudinal baffle defining a first longitudinal edge and a second longitudinal edge, the tubular wall of said casing having a longitudinal slot, said first longitudinal edge being engaged in said longitudinal slot with said second edge bearing against the tubular wall of the casing, whereby the longitudinal baffle and the casing can be secured together by brazing.

2. A condenser according to claim 1, wherein said tubular wall is generally cylindrical.

3. A condenser according to claim 2, wherein said tubes extend in a non-radial direction with respect to the centre of the cylindrical cross section of the tubular wall of the casing.

4. A condenser according to claim 1, wherein said longitudinal baffle comprises two flat wall portions defining an angle between them and defining said first and second longitudinal edges respectively.

5. A condenser according to claim 4, wherein said angle between the two flat wall portions of the longitudinal baffle is substantially a right angle.

6. A condenser according to claim 5, wherein the tubular wall of said casing is generally cylindrical, said angle defined between the two flat wall portions of the longitudinal baffle having an apex disposed substantially at the centre of the circular cross section of the tubular wall of the casing, so that the transverse cross section of said collecting chamber corresponds to substantially one quarter of the total transverse cross section of said tubular wall, and the transverse cross section of the reservoir chamber corresponds substantially to three-quarters of said total transverse cross section.

7. A condenser according to claim 1, further including a plurality of transverse baffles extending transversely within said collecting chamber.

8. A condenser according to claim 7, wherein each said transverse baffle comprises a first portion and a second portion, said first portion constituting a baffle proper and corresponding to the transverse cross section of the collecting chamber, said second portion corresponding to part of the transverse cross section of the reservoir chamber, the said first and second portions defining between them a first slot, said longitudinal baffle having second slots formed in its said second longitudinal edge, said first slot of each transverse baffle being engaged in a corresponding one of said second slots.

9. A condenser according to claim 1, wherein the tubular wall of said casing is formed by rolling a metallic strip, to define two parallel longitudinal edges defining said longitudinal slot between them.

10. A condenser according to claim 1, the components of which are secured together by brazing.

* * * * *